US005513982A

United States Patent [19]

Althaus et al.

[11] Patent Number: 5,513,982

[45] Date of Patent: May 7, 1996

[54] COMBUSTION CHAMBER

[75] Inventors: Rolf Althaus, Flawil; Alexander Beeck, Endingen, both of Switzerland; Yau-Pin Chyou, Taipei, Taiwan; Adnan Eroglu, Untersiggenthal; Burkhard Schulte-Werning, Basel, both of Switzerland

[73] Assignee: ABB Management AG, Baden, Switzerland

[21] Appl. No.: 225,319

[22] Filed: Apr. 8, 1994

[30] Foreign Application Priority Data

Apr. 8, 1993 [CH] Switzerland ..... 1078/93

[51] Int. Cl.[6] ..... F23D 14/46

[52] U.S. Cl. ..... 431/350; 431/354; 431/351; 431/183; 431/185

[58] Field of Search ..... 431/350, 354, 431/185, 182, 351; 60/43, 49, 737

[56] References Cited

U.S. PATENT DOCUMENTS

| | | | |
|---|---|---|---|
| 1,022,493 | 4/1912 | Meigs . | |
| 1,454,196 | 5/1923 | Trodd . | |
| 1,466,006 | 8/1923 | Trodd . | |
| 3,051,452 | 8/1962 | Nobel . | |
| 3,404,869 | 10/1968 | Harder . | |
| 3,974,646 | 8/1976 | Markowski et al. . | |
| 4,164,375 | 8/1979 | Allen | 366/337 |
| 5,340,306 | 8/1994 | Keller et al. | 431/351 |
| 5,423,608 | 6/1995 | Chyou et al. | 366/337 |
| 5,433,596 | 7/1995 | Döbbeling et al. | 431/350 |

FOREIGN PATENT DOCUMENTS

| | | |
|---|---|---|
| 3520772 | 12/1986 | Germany . |
| 3534268A1 | 4/1987 | Germany . |

*Primary Examiner*—Larry Jones
*Attorney, Agent, or Firm*—Burns, Doane, Swecker & Mathis

[57] ABSTRACT

In a combustion chamber, a gaseous or liquid fuel is injected as a secondary flow into a gaseous, channelized main flow. The main flow is directed to pass over a plurality of vortex generators (9) arranged side by side over the width or circumference of the channel (20) through which the flow passes. The height (h) of the vortex generators is at least 50% of the height (H) of the channel through which the flow passes or of that part of the channel associated with the vortex generators. The secondary flow is introduced into the channel (20) in the immediate vicinity of the vortex generators (9). Longitudinal vortices without any recirculation region are produced in the channel through which the flow passes by means of the new static mixer. Extraordinarily short mixing distances, with a low pressure loss at the same time, are thus achieved in a combustion chamber according to the invention.

24 Claims, 5 Drawing Sheets

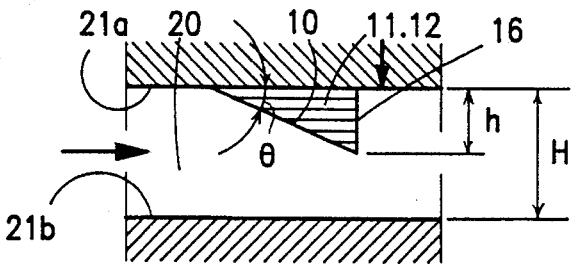
FIG. 3a
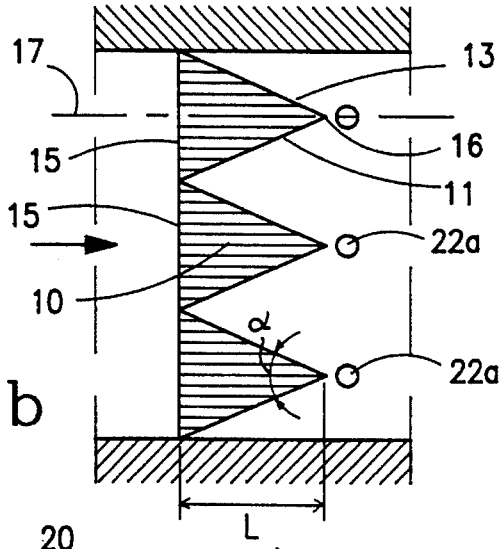
FIG. 3b
FIG. 3c
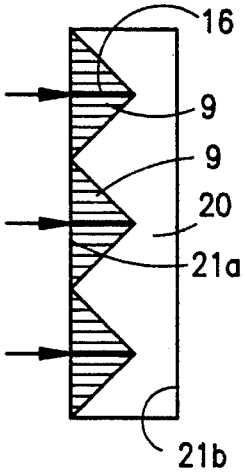
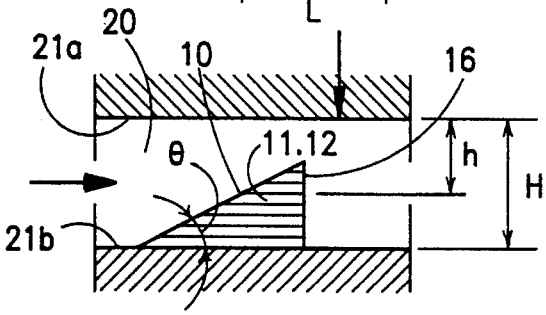
FIG. 4a
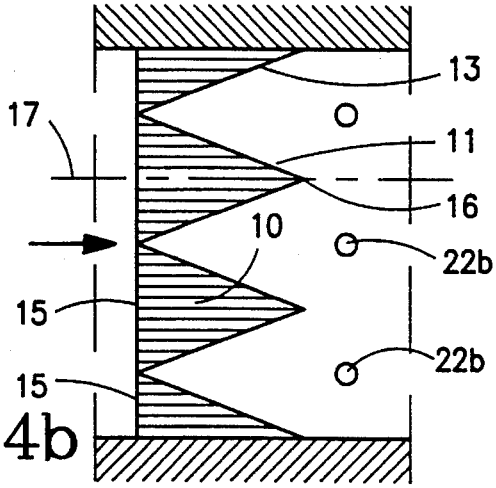
FIG. 4b
FIG. 4c
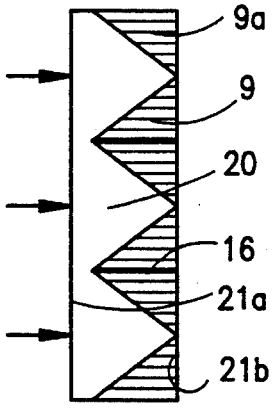

COMBUSTION CHAMBER

BACKGROUND OF THE INVENTION

1. Field of the Invention

The invention relates to a combustion chamber in which a gaseous or liquid fuel is injected as a secondary flow into a gaseous, channelized main flow, the secondary flow having a considerably lower mass flow rate than the main flow.

2. Discussion of Background

Cold flow strands can occur in the main flow in combustion chambers, for example, as a result of the introduction of cooling air into the combustion air. Such flow strands can lead to inadequate combustion in the combustion zone. Measures must therefore be taken in order to mix combustion air, cooling air and fuel internally.

A delta wing which is installed in a flow channel can be regarded as a vortex generator, in the broadest sense. If the incident flow strikes the tip of such a wing, then a stagnation region is formed downstream of the wing on the one hand and, on the other hand, as a result of the installed surface, the flow experiences a not inconsiderable drop in pressure. The arrangement of such a delta wing in a channel must be effected via aids such as webs, ribs or the like which have an adverse affect on the flow. Furthermore, problems arise, for example in a hot-gas flow, with the cooling of such elements.

Such delta wings cannot be used as mixing elements for two or more flows. The mixing of a secondary flow with a main flow which is present in a channel is as a rule carried out by radial injection of the secondary flow into the channel. The impulse of the secondary flow is, however, so small that virtually complete mixing does not take place until after a distance of approximately 100 times the channel height.

SUMMARY OF THE INVENTION

Accordingly, one object of the invention is to provide a novel combustion chamber of the type mentioned initially which is equipped with a device by means of which longitudinal vortices can be produced, without any recirculation region, in the channel through which the flow passes.

This is achieved according to the invention in that the main flow is passed via vortex generators, a plurality of which are arranged side by side over the width or circumference of the channel through which the flow passes, preferably without any interspaces, and whose height is at least 50% of the height of the channel through which the flow passes or of that part of the channel associated with the vortex generators and in that the secondary flow is introduced into the channel in the immediate vicinity of the vortex generators.

Using the new static mixer, which is represented by the three-dimensional vortex generators, it is possible to achieve extremely short mixing distances in the combustion chamber, with a low pressure loss at the same time. Coarse mixing of the two flows is completed even after one complete vortex revolution, while, as a consequence of turbulent flow and molecular diffusion processes, fine mixing takes place after a distance which corresponds to a few times the channel height.

A vortex generator is distinguished by the fact, that it has three surfaces around which the flow passes freely and which extend in the flow direction, one of which forms the top surface and the two others form the side surfaces, that the side surfaces are flush with an identical channel wall and enclose the sweepback angle $\alpha$ between them, that the top surface has an edge which rests against the same channel wall as the side walls and runs transversely with respect to the channel through which the flow passes, and that the longitudinally directed edges of the top surface, which are flush with those longitudinally directed edges of the side surfaces which project into the flow channel, run at an incidence angle $\theta$ to the channel wall.

The advantage of such an element can be seen in its particular simplicity from every viewpoint. In production-engineering terms, the element, which comprises three walls around which the flow passes, is completely free of problems. The top surface can be assembled with the two side surfaces in very different ways. The fixing of the element on flat or curved channel walls in the case of materials which can be welded can also be carried out by simple welding seams. From the fluid-dynamics point of view, the element has a very low pressure loss when flow passes around it and it produces vortices without any stagnation region. Finally, the element can be cooled in very different ways and using various means by means of its interior, which as a rule is hollow.

It is appropriate to select the ratio of the height h of the connecting edge of the two side surfaces with respect to the channel height H such that the pair of vortices produced occupies the complete channel height directly downstream of the vortex generator, or occupies the complete height of that channel part which is associated with the vortex generators.

Since a plurality of vortex generators are arranged side by side, without any interspaces, over the width of the channel through which the flow passes, the vortices act over the complete channel cross section even at a short distance behind the vortex generators.

It is sensible for the two side surfaces which enclose the sweepback angle $\alpha$ to be arranged symmetrically about an axis of symmetry. Vortices of identical spin are thus produced.

If the two side surfaces which enclose the sweepback angle $\alpha$ form a connecting edge with one another which is at least approximately sharp and forms a tip together with the longitudinal edges of the top surface, the blocking produces virtually no adverse effect on the flow cross section.

If the sharp connecting edge is the outlet-side edge of the vortex generator and it runs at right angles to that channel wall with which the side surfaces are flush, then the avoidance of the formation of a wake region which is thus achieved is advantageous. Furthermore, a vertical connecting edge leads to side surfaces which are likewise at right angles to the channel wall, which gives the vortex generator the simplest possible shape and the shape which is most favorable in production-engineering terms.

If the axis of symmetry runs parallel to the channel axis and the connecting edge of the two side surfaces forms the downstream edge of the vortex generator while, in consequence, that edge of the top surface which runs transversely with respect to the channel through which the flow passes is the edge on which the channel flow initially acts, then two identical contrarotating vortices are produced on one vortex generator. A flow pattern of neutral spin is thus provided, in the case of which the rotation direction of the two vortices is such that the flow is rising in the region of the connecting edge.

For certain applications it is expedient if the incidence angle θ of the top surface and/or the sweepback angle α of the side surfaces are selected such that the vortex which is produced by the flow still breaks down in the region of the vortex generator. With the possible variation of the two angles, a simple aerodynamic stabilization means is available irrespective of the cross sectional shape of the channel through which the flow passes, which can be both broad and low as well as narrow and high, and can be provided with flat or curved channel walls.

Further advantages of the invention, particularly in conjunction with the arrangement of the vortex generators and the introduction of the secondary flow, result from the subclaims.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIGS. 3*a*, 3*b* and 3*c* show the grouped arrangement of vortex generators in a channel in longitudinal section, in a plan view and in a rear view;

FIGS. 4*a*, 4*b* and 4*c* show a design variant of a grouped arrangement of vortex generators in the same illustration as in FIG. 3, with a variant of the secondary flow guidance;

The flow direction of the equipment is marked by arrows. The same elements are in each case provided with the same reference designations in the various figures. Elements such as housings, fastenings, line bushings and the like which are not significant to the invention are omitted.

DESCRIPTION OF THE PREFERRED EMBODIMENTS

The vortex generator which is essential to the method of operation of the invention will be described first, before going into the actual combustion chamber.

Figure 1:
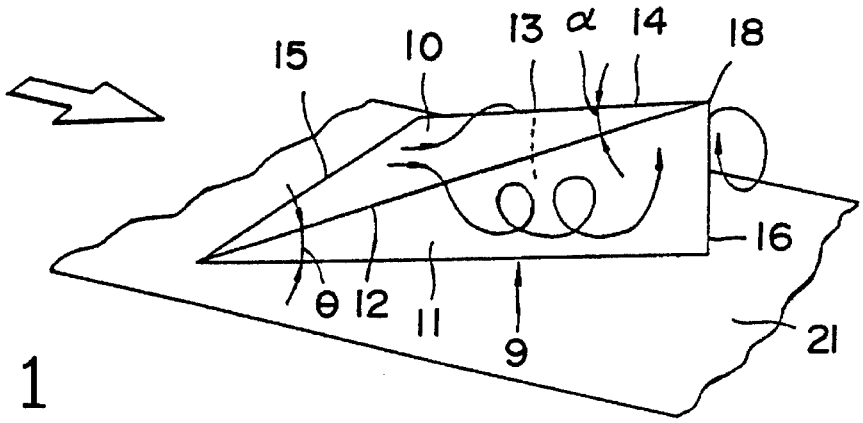
FIG. 1 shows a perspective illustration of a vortex generator.
Figure 5:
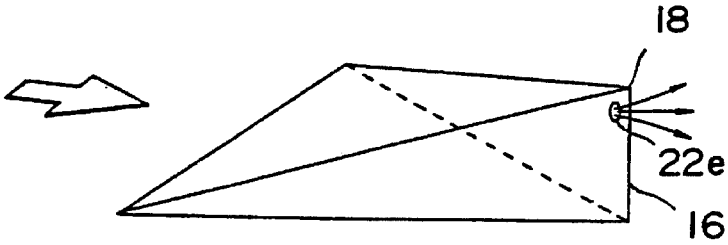
FIG. 5 shows a second variant of the secondary flow guidance.

Referring now to the drawings, wherein like reference numerals designate identical or corresponding parts throughout the several views, in FIGS. 1, 5 and the actual channel, through which a main flow passes which is symbolized by a large arrow, is not illustrated. According to these figures, a vortex generator essentially comprises three triangular surfaces around which the flow passes freely. These are a top surface 10 and two side surfaces 11 and 13. In their longitudinal extent, these surfaces run at specific angles in the flow direction.

In all the examples shown, the two side surfaces 11 and 13 are at right angles to the channel wall 21, it being noted that this is not essential. The side walls which comprise right-angled triangles are fixed by means of their longitudinal sides on this channel wall 21, preferably in a gas-tight manner. They are thus oriented such that they form a joint on their narrow sides enclosing a sweepback angle α. The joint is designed as a sharp connecting edge 16 and is likewise at right angles to that channel wall 21 with which the side surfaces are flush. The two side surfaces 11, 13 which enclose the sweepback angle α are symmetrical in shape, size and orientation and are arranged on both sides of an axis of symmetry 17 (FIGS. 3*b*, 4*b*). This axis of symmetry 17 is in the same direction as the channel axis.

The top surface 10 has an edge 15, which is constructed with a very sharp tip, runs transversely with respect to the channel through which the flow passes and rests against the same channel wall 21 as the side walls 11, 13.

The longitudinally directed edges 12, 14 of the top surface 10 are flush with those longitudinally directed edges of the side surfaces which project into the flow channel. The top surface is positioned at an incidence angle θ with respect to the channel wall 21. The longitudinal edges 12, 14 come together at a tip 18 with the connecting edge 16.

The vortex generator can, of course, also be provided with a base surface by means of which it is fastened to the channel wall 21 in a suitable manner. However, such a base surface has no connection with the method of operation of the element.

In FIG. 1, the connecting edge 16 of the two side surfaces 11, 13 forms the downstream edge of the vortex generator. That edge 15 of the top surface 10 which runs transversely with respect to the channel through which the flow passes is thus the edge on which the channel flow initially acts.

The method of operation of the vortex generator is as follows: while the flow is passing around the edges 12 and 14, the main flow is converted into a pair of contrarotating vortices. Their vortex axes lie on the axis of the main flow. The number of turns and the location of the vortex breakdown, to the extent that the latter is desired at all, are determined by suitable selection of the incidence angle θ and of the sweepback angle α. As the angles increase, the vortex intensity and the number of turns increases and the location of the vortex breakdown moves upstream as far as the region of the vortex generator itself. Depending on the application, these two angles θ and α are predetermined by design characteristics and by the process itself. Only the length L of the element (FIG. 3*b*) and the height h of the connecting edge 16 (FIG. 3*a*) need then still be matched.

In FIGS. 3*a* and 4*a*, in which the channel through which the flow passes is designated by 20, it can be seen that the vortex generator can have different heights with respect to the channel height H. As a rule, the height h of the connecting edge 16 is selected for the channel height H such that the vortex which is produced reaches a magnitude even immediately downstream of the vortex generator such that the complete channel height H is occupied, which leads to a uniform speed distribution in the cross section acted on. A further criterion which can influence the selectable ratio h/H is the pressure drop which occurs while the flow is passing around the vortex generator. It is self-evident that the pressure loss coefficient also rises with a larger ratio h/H.

Figure 2:
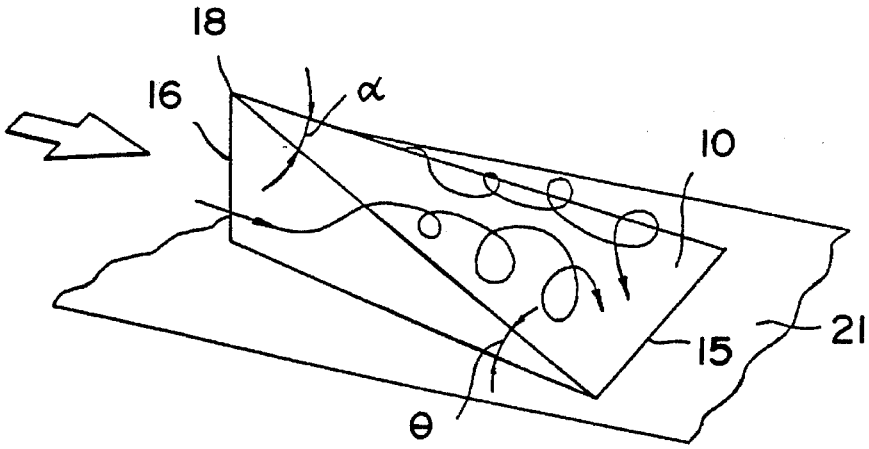
FIG. 2 shows an arrangement variant of the vortex generator.

In contrast to FIG. 1, the sharp connecting edge 16 in FIG. 2 is that point on which the channel flow acts initially. The element is rotated through 180°. As can be seen from the illustration, the two contrarotating vortices have changed their direction of rotation.

FIGS. 3*a–c* show how a plurality of vortex generators, in this case three, are arranged side by side without interspaces over the width of the channel 20 through which the flow passes. In this case, the channel 20 has a rectangular shape, but this is not significant to the invention.

FIG. 4 shows a design variant having two full vortex generators and two half vortex generators which are adjacent thereto on both sides. With the same channel height H and the same incidence angle θ of the top surface 10 as in FIGS. 3*a–c*, the elements differ especially as a result of their greater height h. With a constant incidence angle, this necessarily leads to a greater length L of the element and, in consequence, also—because of the same spacing—to a smaller sweepback angle α. In comparison with FIG. FIGS. 3*a–c*, the vortices which are produced have a lower spin intensity but completely occupy the channel cross section within a shorter interval. If vortex breakdown is intended in both cases, for example for stabilizing the flow, this will take place later in the case of the vortex generator according to FIGS. 4*a–c* than in the case of that according to FIGS. 3*a–c*.

The channels which are illustrated in FIGS. 3*a–c* and 4*a–c* represent rectangular combustion chambers. Once again it should be noted that the shape of the channel through which the flow passes is not significant for the method of operation of the invention. Instead of the rectangle shown, the channel could also comprise an annular segment, that is to say the walls 21*a* and 21*b* would be curved. The above statement that the side surfaces are at right angles to the channel wall must, of course, be made relative in such a case. The significant factor is that the connecting edge 16, which lies on the line of symmetry 17, is at right angles to the corresponding wall. In the case of annular walls, the connecting edge 16 would thus be aligned radially, as is illustrated in FIG. 7.

Figure 6:
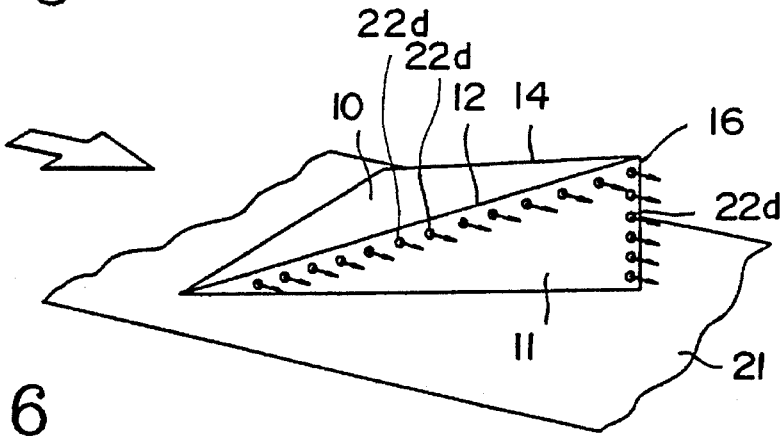
FIG. 6 shows a third variant of the secondary-flow guidance.
Figure 7:
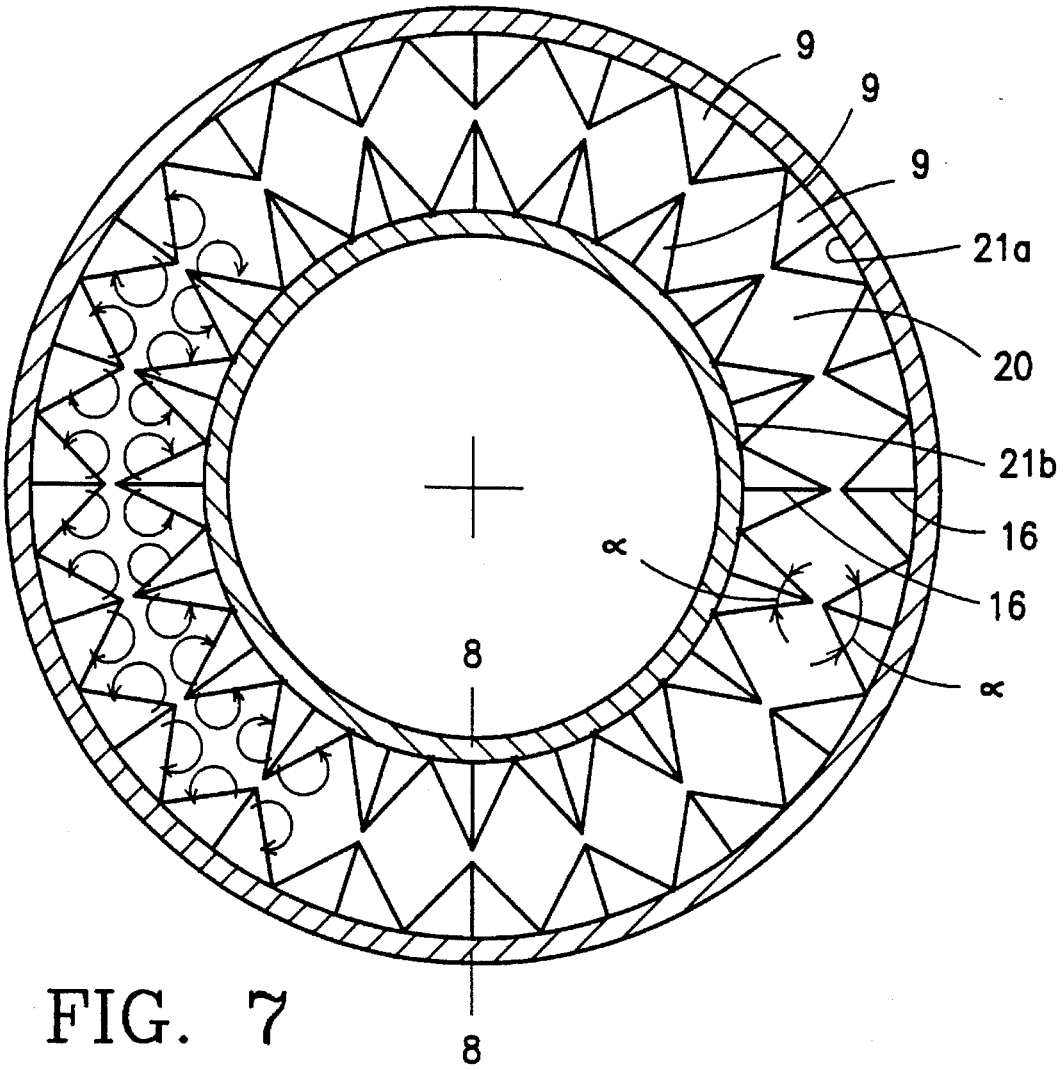
FIG. 7 shows the annular combustion chamber of a gas turbine having built-in vortex generators.
Figure 8:
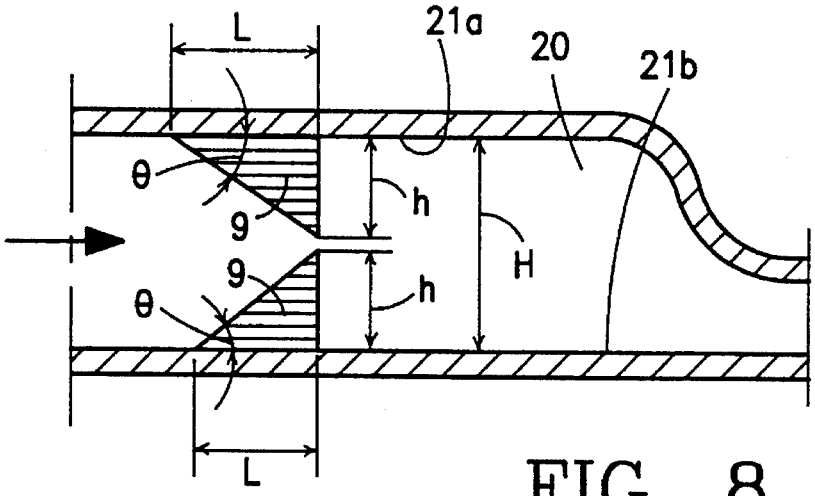
FIG. 8 shows a partial longitudinal section through a combustion chamber along the line 8—8 in FIG. 7.

FIGS. 7 and 8 show in simplified form a combustion chamber having a channel 20 through which the flow passes in an annular shape. An identical number of vortex generators are in each case arranged in a row in the circumferential direction on both channel walls 21*a* and 21*b* such that the connecting edges 16 of two opposite vortex generators lie on the same radial. If identical heights h are specified for opposite vortex generators, then FIG. 7 shows that the vortex generators have a smaller sweepback α on the inner channel annulus 21*b*. In the longitudinal section in FIG. 8 it can be seen that this could be compensated for by a larger incidence angle θ if vortices having identical spin are desired in the inner and outer annulus cross section. In the case of this solution, as is indicated in FIG. 7, two pairs of vortices are produced which each have relatively small vortices, which leads to a shorter mixing length. In the case of this design, the fuel could be introduced into the main flow in accordance with the methods in FIG. 5 or 6, which will be described later.

In FIGS. 3*a–c* and 4*a–c* which have already been described, two flows are mixed with one another with the aid of the vortex generators 9. The main flow, in the form of combustion air—or combustion gas depending on the type of combustion chamber—attacks the transversely directed leading edges 15 in the direction of the arrow. The secondary flow in the form of a fuel which is, for example, liquid has a considerably lower mass flow rate than the main flow. It is introduced into the main flow at right angles, in the immediate vicinity of the vortex generators.

According to FIG. FIGS. 3*a–c*, this injection is effected via individual holes 22*a* which are incorporated in the wall 21*a*. The wall 21*a* is that wall on which the vortex generators are arranged. The holes 22*a* are located on the line of symmetry 17, downstream behind the connecting edge 16 of each vortex generator. In the case of this configuration, the fuel is introduced into the already existing large-scale vortices.

FIG. 4 shows a design variant of a combustion chamber in the case of which the secondary flow is likewise injected via wall holes 22*b*. The latter are located downstream of the vortex generators in that wall 21*b* on which the vortex generators are not arranged, that is to say on the wall which is opposite the wall 21*a*. The wall holes 22*b* are in each case incorporated centrally between the connecting edges 16 of two adjacent vortex generators, as can be seen in FIG. 4*b*. In this way, the fuel passes into the vortices in the same manner as in the design according to FIGS. 3*a–c*. However, the difference is that it is no longer mixed into the vortices of a pair of vortices produced by an identical vortex generator but into in each case one vortex of two adjacent vortex generators. Since the adjacent vortex generators are, however, arranged without any interspace and produce pairs of vortices with the same direction of rotation, the injection methods according to FIGS. 3*a–c* and 4*a–c* have the same effect.

FIGS. 5 and 6 show further possible forms for the introduction of the secondary flow into the main flow. Here, the secondary flow is introduced into the hollow interior of the vortex generator through the channel wall 21, via means which are not shown.

According to FIG. 5, the secondary flow is injected into the main flow via a wall hole 22*e*, the hole being arranged in the region of the tip 18 of the vortex generator.

In FIG. 6, the injection is effected via wall holes 22*d*, which are located in the side surfaces 11 and 13, on the one hand in the region of the longitudinal edges 12 and 14 and on the other hand in the region of the connecting edge 16.

Finally, FIGS. 9 to 14 show different installation possibilities for the vortex generators.

Figure 9:
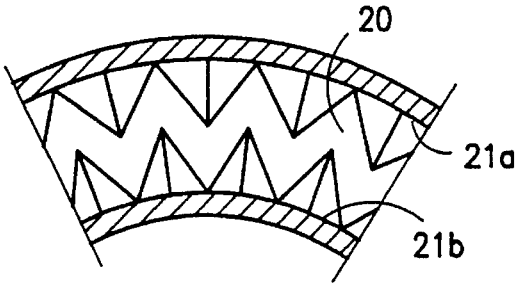
FIG. 9 shows a second arrangement variant for the vortex generators.

As in FIG. 7, the partial view in FIG. 9 shows an annular channel 20 in the case of which an identical number of vortex generators 9 are arranged in a row in the circumferential direction both on the outer annular wall 21*a* and on the inner annular wall 21*b*. However, in contrast to FIG. 7, the connecting edges 16 of in each case two opposite vortex generators are here offset with respect to one another by half of the spacing. This arrangement offers the possibility of increasing the height h of the individual element. The vortices which are produced are combined with one another downstream of the vortex generators, which on the one hand further improves the mixing quality and on the other hand leads to a longer life of the vortex.

Figure 10:
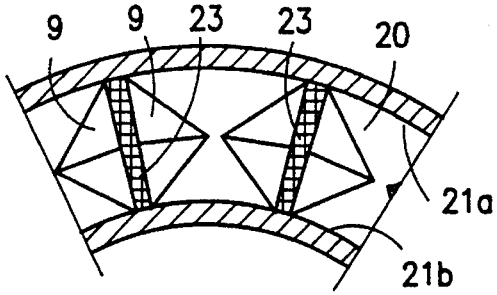
FIG. 10 shows a third arrangement variant for the vortex generators.

In the partial view according to FIG. 10, the annular channel is segmented by means of radially running ribs 23. In the circular-ring segments formed in this manner, in each case one vortex generator 9 is arranged on the ribs 23. In the case shown, the two vortex generators are designed such that they occupy the entire channel height. This solution simplifies the fuel supply, which can be carried out through the ribs, which are designed hollow. There is thus no adverse effect on the flow as a result of centrally arranged fuel lances.

Figure 11:
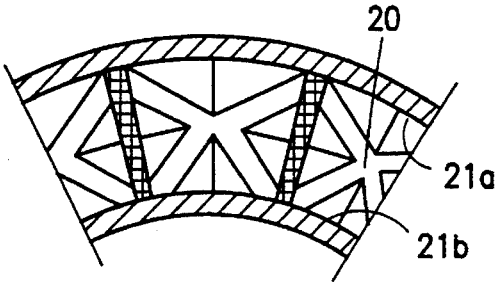
FIG. 11 shows a fourth arrangement variant for the vortex generators.

In the partial view according to FIG. 11, in addition to the side vortex generators as in the case of FIG. 10, vortex producers are also fitted on the annular walls 21*a* and 21*b*. The connecting edges of the side elements run at half the height of the channel, that of the upper and of the lower elements on a radial at half the segment width. This is a very good solution in terms of the method of operation. In contrast to the variant according to FIG. 10, the elements here cannot occupy the entire channel height. It must therefore not be forgotten that the cooling which is possibly required is structurally complex since it is not possible to supply cooling air for the side elements directly from the annular walls.

Figure 12:
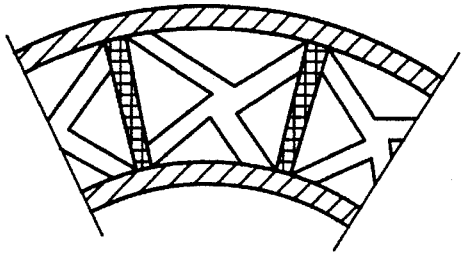
FIG. 12 shows a fifth arrangement variant for the vortex generators.

As a remedy for this, in contrast to FIG. 11, the vortex generators 9 in FIG. 12 are arranged eccentrically on the radial ribs 23 and on the annular walls 21*a*, 21*b*. In this case, one side surface of each vortex generator in each case rests against a corner of the circular-ring segment, from where the side vortex generators can also be supplied with cooling air from the radially outer annular wall 21*a* on the one side and from the inner annular wall 21*b* on the other side.

Figure 13:
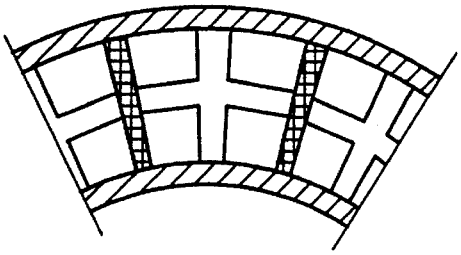
FIG. 13 shows a sixth arrangement variant for the vortex generators.

In yet another design according to FIG. 13, likewise with respect to a simple cooling capability, the vortex generators 9 are arranged directly in the segment corners in each segment of the circular-ring channel.

Figure 14:
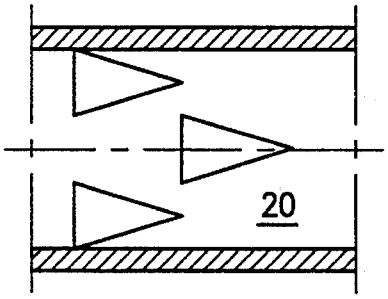
FIG. 14 shows a seventh arrangement variant for the vortex generators in a plan view.

In the plan view according to FIG. 14, the possibility can be seen of not accommodating the vortex generators in the same plane. Of the vortex generators which are arranged in a row with their side walls against a channel wall, two adjacent elements are in each case offset with respect to one another in the longitudinal direction of the channel 20. In the case of this variant, vortex overlapping takes place in the circumferential direction. This is a measure which is suitable for optimizing the combination of pairs of vortices. Different geometries can be selected for the vortex generators, which are connected one behind the other. Furthermore, the arrangement in different planes of the channel has a favorable influence against the building up of acoustic oscillations.

Figure 15A:
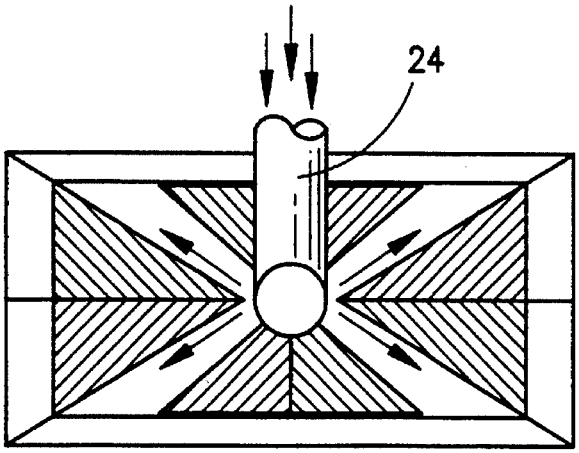
FIGS. 15*a*, 15*b* and 15*c* show a further combustion chamber in longitudinal section, in a plan view and in a rear view.
Figure 15B:
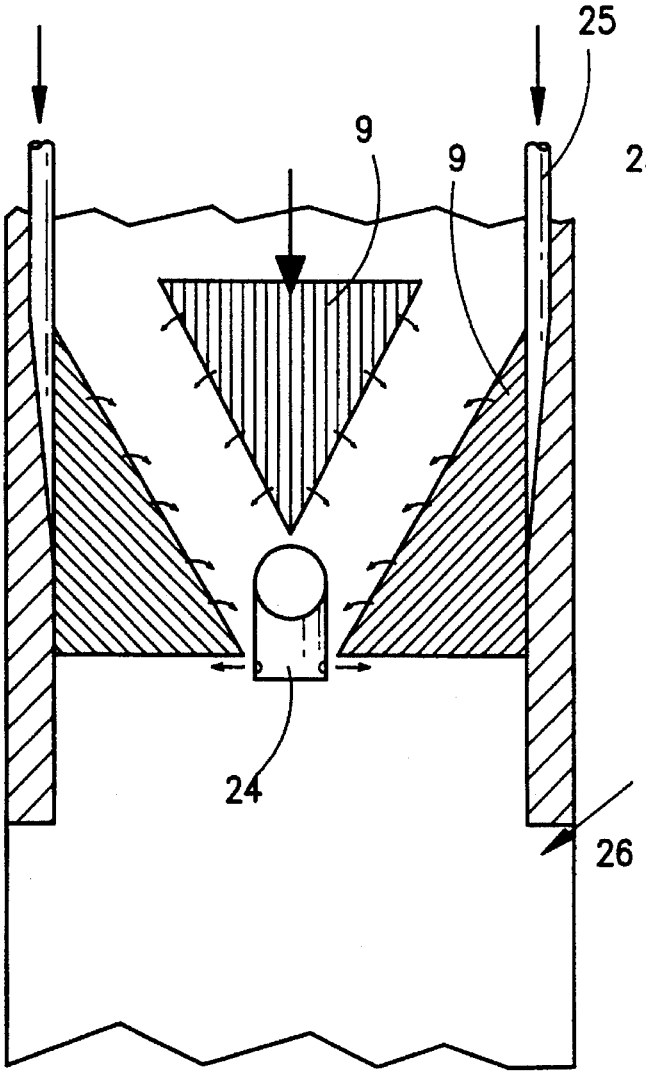
Figure 15C:
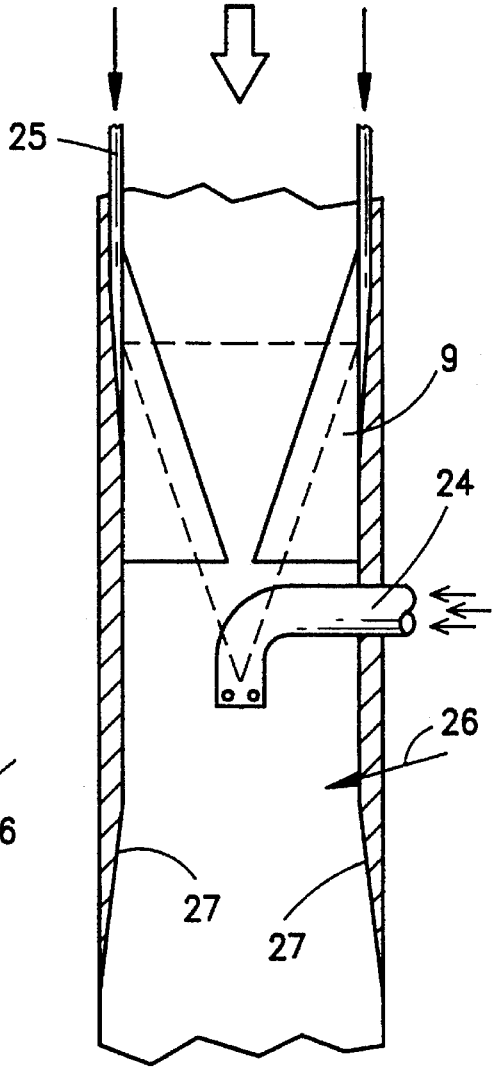

FIGS. 15*a–c* show the secondary flow additionally being introduced centrally in a mixed arrangement of the variants dealt with in FIGS. 6, 11 and 14. The fuel, as a rule oil, is injected via a central fuel lance 24 whose mouth is located downstream of the vortex generators 9, in the region of their tips 18. In the case of a rectangular channel which, of course, could just as well be a circular-ring segment, vortex generators of different geometry are used on one side. Furthermore, the successive vortex generators in the "circumferential direction" are slightly offset with respect to one another. This is, for example, to create sufficient space for the lance. Finally, the partial injection of the secondary flow is effected via wall holes in the side surfaces of the vortex generators, as is indicated by arrows. The gas supply is effected via gas lines 25 which run along the wall. Using the configuration shown, such a combustion chamber would be well suited for dual operation with premixing combustion. In the case of a pressure drop coefficient of 3, good mixing is achieved even after approximately three times the channel height. The mixture is ignited 26 at the point at which the vortex breaks down. For additional flame stabilization, a diffusor 27 is arranged in the plane behind the mixing zone on which the ignition takes place. The good temperature distribution, which is achieved as a result of the mixing elements, downstream of the vortex generators avoids the risk of surges, which, without the measure, are possible in the case of cooling air being introduced, as mentioned initially, into the combustion air.

The combustion chamber just described could furthermore be a self-igniting afterburning chamber downstream of a high-temperature gas turbine. The high energy content of its exhaust gases makes self-ignition possible. A precondition for optimization of the combustion process, especially with respect to minimizing emissions, is effective, rapid mixing of the hot-gas flow with the injected fuel.

On the basis of a vortex generator configuration according to FIGS. 15*a–c*, with central injection of the fuel via a lance, the vortex generators are designed such that recirculation zones are avoided to a very large extent. In consequence, the dwell time of the fuel particles in the hot zones is very short, which has a favorable influence on the minimal formation of $NO_x$. The injected fuel is dragged along by the vortices and is mixed with the main flow. It follows the helical course of the vortices and is distributed uniformly and finely in the chamber downstream of the vortices. This reduces the risk—in the case of the initially mentioned radial injection of fuel into a flow without vortices—of jets striking against the opposite wall and forming so-called "hot spots".

Since the main mixing process takes place in the vortices and is largely insensitive to the injection impulse of the secondary flow, the fuel injection can be kept flexible and can be matched to other boundary conditions. The same injection impulse can thus be maintained throughout the load range. Since the mixing is governed by the geometry of the vortex generators and not by the machine load, the gas turbine power in the case of the example, the afterburner configured in this way operates in an optimum manner even in partial-load conditions. The combustion process is optimized by matching the ignition delay time of the fuel and the mixing time of the vortices, which ensures that emissions are minimized.

Furthermore, the effective mixing produces a good temperature profile over the cross section through which the flow passes and, furthermore, reduces the possibility for thermo-acoustic instability to occur. Just by their presence, the vortex generators act as a damping measure against thermo-acoustic oscillations.

Figure 16:
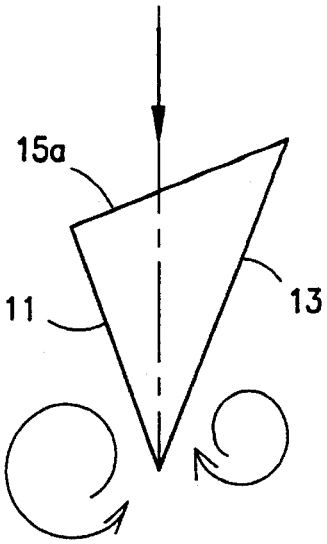
FIG. 16 shows a further design variant of the vortex generator.
Figure 17:
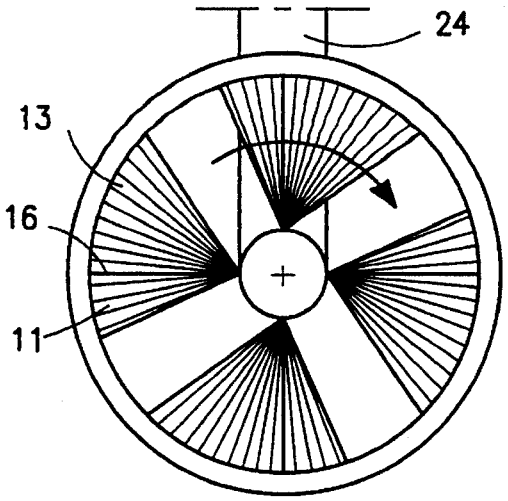
FIG. 17 shows an arrangement variant of the vortex generator according to FIG. 16.

FIGS. 16 and 17 show a plan view of a design variant of the vortex generator and a front view of its arrangement in a circular channel. The two side surfaces 11 and 13 which enclose the sweepback angle $\alpha$ have a different length. This means that the top surface 10, having an edge 15*a* which runs obliquely with respect to the channel through which the flow passes, rests against the same channel wall as the side walls. The vortex generator then has a different incidence angle $\theta$, of course, over its width. Such a variant has the effect that vortices having a different intensity are produced. For example, it is thus possible to act on a spin which adheres to the main flow. Alternatively, however, a spin, as is indicated in FIG. 17, can be imposed, downstream of the vortex generators, on the originally spin-free main flow, by means of the different vortices. Such a configuration is well suited for use as an autonomous, compact burner unit. If a plurality of such units are used, for example in a gas turbine annular combustion chamber, the spin which is imposed on the main flow can be utilized in order to improve the transverse ignition behavior of the burner configuration, for example at partial load.

Obviously, numerous modifications and variations of the present invention are possible in light of the above teachings. It is therefore to be understood that within the scope of the appended claims, the invention may be practiced otherwise than as specifically described herein. With respect to the arrangement of the vortex generators as an assembly, a large number of combinations are possible within the context of the invention. It is also possible to introduce the secondary flow into the main flow in a wide range of ways.

What is claimed is:

1. In a combustion chamber in which a gaseous or liquid fuel is injected as a secondary flow into a channel with a gaseous, main flow, the secondary flow having a considerably lower mass flow rate than the main flow, the improvement comprising:

a plurality of vortex generators arranged side by side over the width or circumference of the channel through which the flow passes, the vortex generators having a height at least 50% of a height of the channel through which the flow passes, and means for introducing a secondary flow into the channel in the immediate vicinity of the vortex generators.

2. The combustion chamber as claimed in claim 1, wherein each vortex generator comprises three surfaces projecting from a channel wall into the channel around which the flow passes freely, the surfaces each having a longitudinal dimension extending in a flow direction, one of the surfaces comprising a top surface and the two other surfaces forming side surfaces, the side surfaces are each attached along an edge to the channel wall and are relatively oriented to define a sweepback angle between them, the top surface having an edge resting on the same channel wall to which the side walls are attached and oriented transversely with respect to the flow direction of the channel, and wherein longitudinally directed edges of the top surface are joined with longitudinally directed edges of the side surfaces which project into the flow channel, and the top surface is oriented at an incidence angle to the channel wall.

3. The combustion chamber as claimed in claim 2, wherein a ratio of a height of the vortex generator to a channel height is selected so that a vortex produced by the vortex generator occupies the entire channel height immediately downstream of the vortex generator.

4. The combustion chamber as claimed in claim 2, wherein the two side surfaces of each vortex generator are positioned symmetrically about an axis of symmetry.

5. The combustion chamber as claimed in claim 4, wherein edges of the two side surfaces form a connection edge, the longitudinally directed edges of the top surface and the connecting edge forming a tip, and wherein the connecting edge is oriented at a right angle to channel wall on which the side surfaces are attached.

6. The combustion chamber as claimed in claim 5, wherein at least one of the connecting edge and the longitudinally directed edges of the top surface are constructed to be at least approximately sharp.

7. The combustion chamber as claimed in claim 5, wherein each vortex generator is positioned in the flow channel so that the axis of symmetry of the vortex generator is parallel to a channel axis, the connecting edge of the two side surfaces is positioned as a downstream end of the vortex generator and the edge of the top surface that runs transversely with respect to the channel is positioned as an upstream end of the vortex generator.

8. The combustion chamber as claimed in claim 5, wherein the means for introducing a secondary flow comprises holes located in the side surfaces of each vortex generator said holes being positioned adjacent to at least one of the longitudinally directed edges of the top surface and the connecting edge.

9. The combustion chamber as claimed in claim 5, wherein the means for introducing a secondary flow comprises a hole located adjacent to the tip of each vortex generator.

10. The combustion chamber as claimed in claim 4, wherein the channel is annular and wherein an identical plurality of vortex generators are arranged in a row in the circumferential direction both on an outer annular wall and on an inner annular wall (**21*b***), each vortex generator on the inner annular wall being paired with a vortex generator on the outer annular wall, the paired vortex generators being positioned so that the respective connecting edges are radially aligned.

11. The combustion chamber as claimed in claim 4, wherein the channel is annular and wherein an identical plurality of vortex generators are arranged in a row in the circumferential direction both on an outer annular wall and on an inner annular wall, each vortex generator on the inner annular wall being positioned so that the connecting edge is aligned between two adjacent vortex generators on the outer annular wall.

12. The combustion chamber as claimed in claim 2, wherein the two side surfaces of each vortex generator each have a different length, so that the top surface edge which rests against the same channel wall as the side walls runs obliquely with respect to the flow direction, and the incidence angle of the top surface varies over a width of the vortex generator.

13. The combustion chamber as claimed in claim 2, wherein at least one of the incidence angle of the top surface and the sweepback angle of the side surfaces are selected so that the vortex produced breaks down in the region of the vortex generator.

14. The combustion chamber as claimed in claim 2, wherein the channel is annular, the plurality of vortex generators is arranged in a row in the circumferential direction on one of an inner annular wall and outer annular wall, and wherein the means for introducing a secondary flow comprises a plurality of channel wall holes each hole associated with one vortex generator and located on the annular wall along a vortex generator line of symmetry directly downstream of the associated vortex generator.

15. The combustion chamber as claimed in claim 2, wherein the channel is annular, the plurality of vortex generators is arranged in a row in a circumferential direction of the channel on at least one of an inner channel wall and outer annular wall, and wherein the means for introducing a secondary flow comprises a plurality of channel wall holes, arranged downstream of the vortex generators in the annular wall on which the vortex generators are not arranged, each wall hole being positioned centrally between adjacent vortex generators.

16. The combustion chamber as claimed in claim 2, wherein the channel is a circular-ring channel, and further comprises a plurality of radial ribs dividing the circular-ring channel into flow segments, in each flow segment a vortex generator being arranged on at least one of the radial ribs and on the annular walls.

17. The combustion chamber as claimed in claim 16, wherein in each flow segment the vortex generators are positioned centrally at least one of the radial ribs and on the annular walls.

18. The combustion chamber as claimed in claim 16, wherein in each flow segment the vortex generators are positioned eccentrically on at least one of the radial ribs and the annular walls, one side surface of each vortex generator in each flow segment resting against a corner of the circular-ring segment.

19. The combustion chamber as claimed in claim 2, wherein the channel is a circular-ring channel, and further comprising a plurality Of radial ribs dividing the channel into flow segments, the vortex generators in each flow segment being arranged in the corners of the flow segment.

20. The combustion chamber as claimed in claim 2, wherein adjacent vortex generators are positioned mutually offset in the longitudinal direction of the channel in two rows.

21. The combustion chamber as claimed in claim 2, wherein the means for introducing a secondary flow comprises a fuel lance projecting into the flow channel and positioned so that a mouth is located downstream of the vortex generators.

22. The combustion chamber as claimed in claim 2, wherein said combustion chamber is a combustion chamber with premixing combustion, and further comprises a diffusor arranged in a plane on which external ignition is effected, for flame stabilization downstream of the vortex generators.

23. The combustion chamber as claimed in claim 3, wherein the combustion chamber is a self-igniting afterburning chamber.

24. The combustion chamber as claimed in claim 1, wherein the vortex generators are positioned in laterally abutting relationship.

* * * * *